US005375584A

United States Patent [19]

Hsu

[11] Patent Number: 5,375,584

[45] Date of Patent: Dec. 27, 1994

[54] ADJUSTABLE PLUNGER FOR AN ARCHERY BOW RISER

[75] Inventor: Gary Hsu, Canoga Park, Calif.

[73] Assignee: Micro Inventions Technology Inc., West Hills, Calif.

[21] Appl. No.: 61,458

[22] Filed: May 17, 1993

[51] Int. Cl.[5] ..... F41B 5/00

[52] U.S. Cl. ..... 124/44.5; 124/24.1

[58] Field of Search ..... 124/86, 88, 24.1, 44.5, 124/89, 23.1, 26

[56] References Cited

U.S. PATENT DOCUMENTS

| | | | |
|---|---|---|---|
| 3,232,286 | 2/1966 | Guyton | 124/24.1 |
| 3,482,563 | 12/1969 | Pint | 124/24.1 |
| 4,119,078 | 10/1978 | Wilson et al. | 124/44.5 |
| 4,170,980 | 10/1979 | Killian | 124/44.5 |
| 4,542,731 | 9/1985 | Quartino | 124/24.1 |
| 4,592,332 | 6/1986 | Topping | 124/44.5 |
| 4,648,376 | 3/1987 | Saunders | 124/44.5 |
| 4,809,670 | 3/1989 | Simo | 124/44.5 |
| 4,924,841 | 5/1990 | Smith | 124/44.5 |
| 5,081,980 | 1/1992 | Newbold | 124/44.5 |
| 5,150,700 | 9/1992 | Troncoso | 124/24.1 X |

*Primary Examiner*—Randolph A. Reese
*Assistant Examiner*—Harry C. Kim
*Attorney, Agent, or Firm*—Thomas I. Rozsa; Tony D. Chen

[57] ABSTRACT

The present invention is a novel and unique adjustable plunger for an archery bow riser. The present invention utilizes the archery bow riser threaded aperture common to nearly all modern conventional archery bows. It provides a considerably improved method for tuning a plunger for balancing the side pressure from an arrow, so that the tuning process can take a matter of minutes instead of hours. The present invention includes an index micro adjustment which is a linear tension indicator scale for tightening or loosening the tension on the biasing spring. The present invention is fully adjustable in a longitudinal direction.

37 Claims, 2 Drawing Sheets

FIG. 1
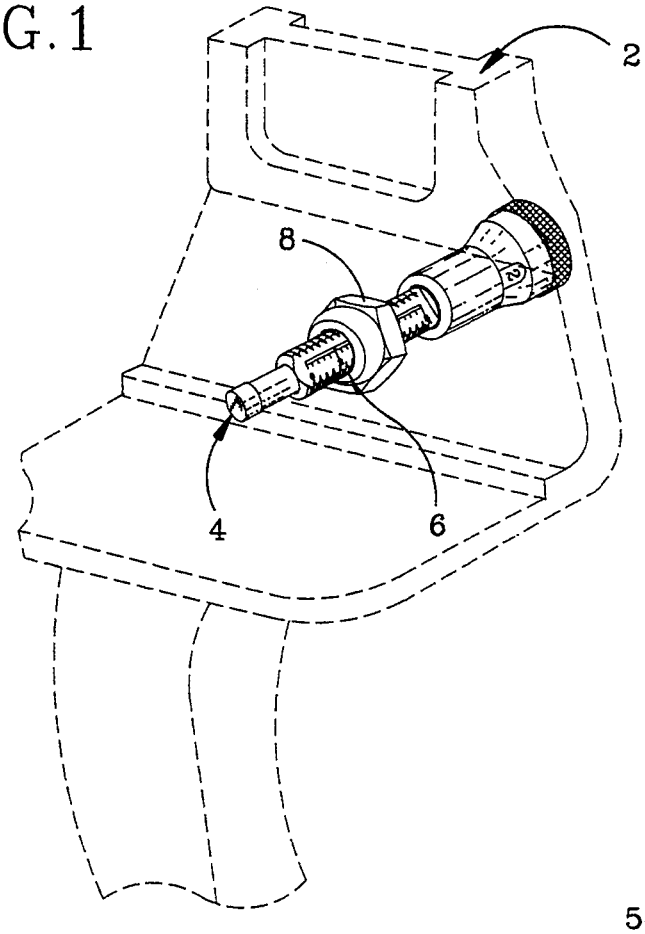
FIG. 4
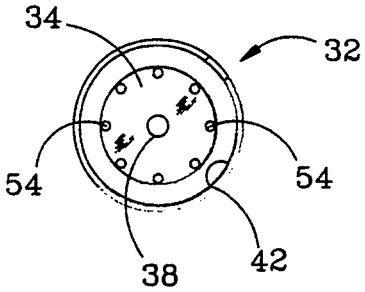
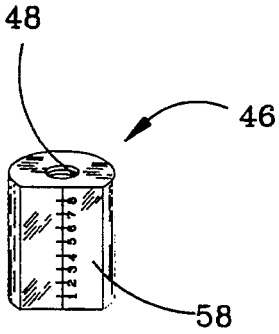
FIG. 5
FIG. 6
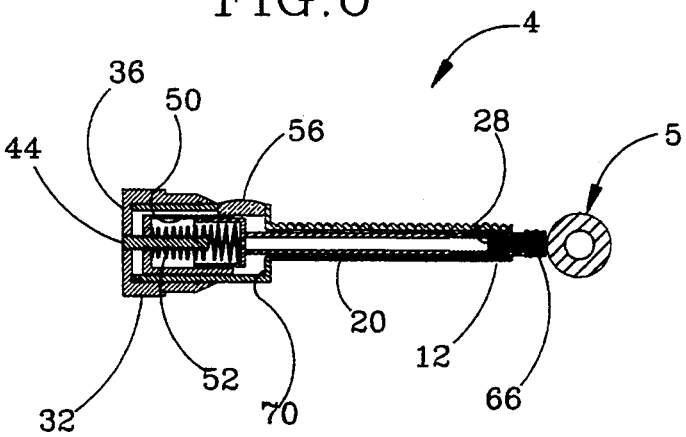

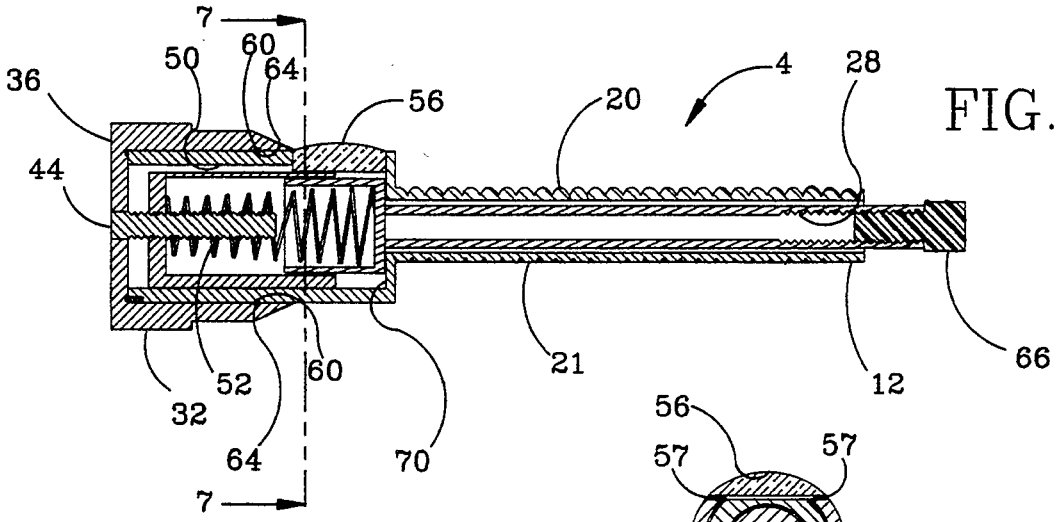
FIG.3
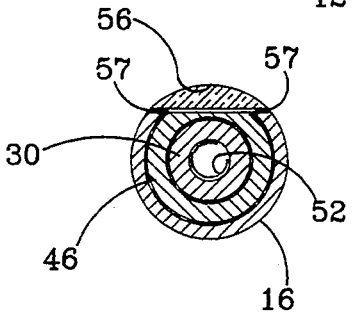
FIG.7
FIG.2
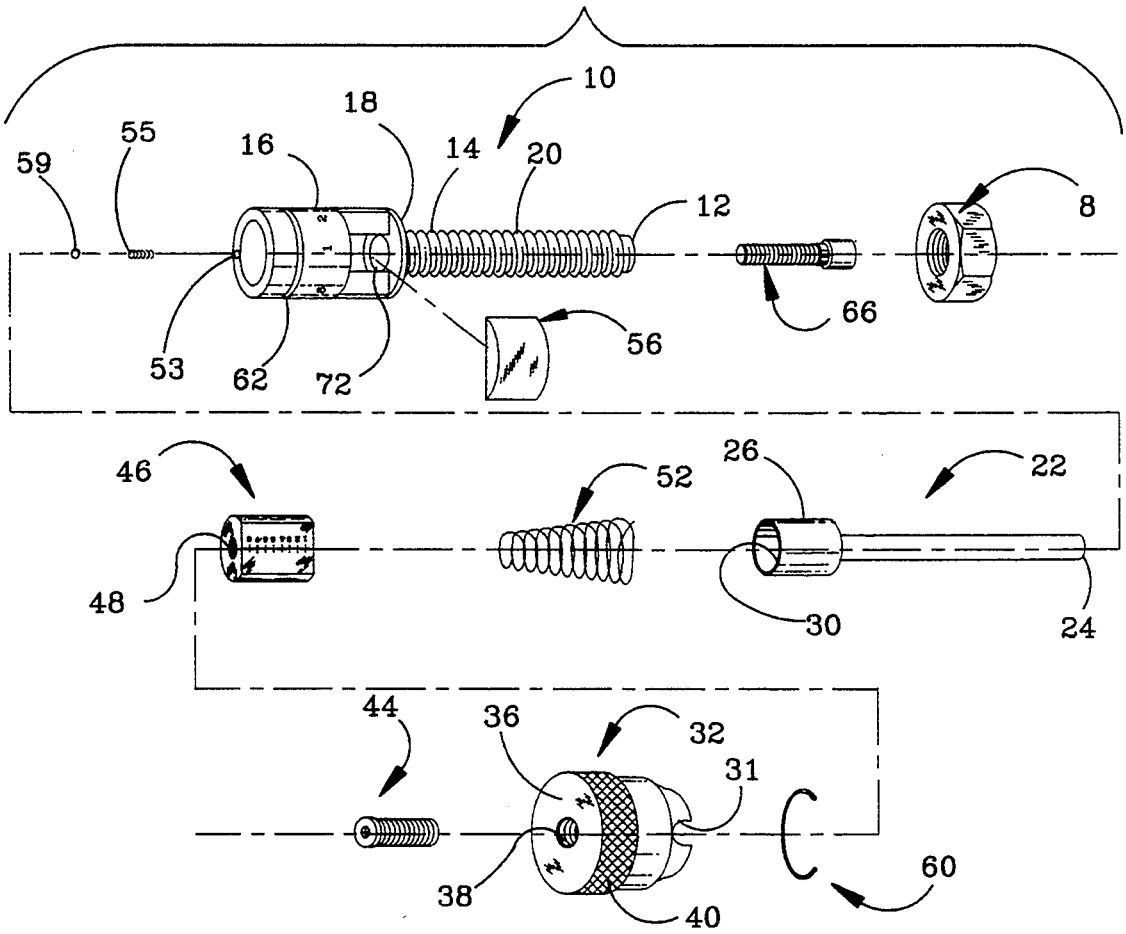

ADJUSTABLE PLUNGER FOR AN ARCHERY BOW RISER

BACKGROUND OF THE INVENTION

1. Field of The Invention

The present invention relates to archery bows for guiding arrows before and during the release of the arrow from the archery bow. In particular, the present invention relates to an adjustable plunger for balancing the side pressure from the arrow.

2. Description of The Prior Art

Archery bows and arrows have been in existence since the days of Robin Hood, however the technology of archery bows and arrows has changed considerably since then and through the years, new and improved archery bows and arrows have been introduced into the consumer market. Serious archers in today's consumer market use archery bows and arrows for hunting and sporting events and there is an ever increasing demand for a bow that will shoot arrows with a high degree of accuracy. To achieve this requires accessories that assist in maintaining the consistency of the trajectory of the arrow. One of the most important accessories is a plunger. Plungers are known in the prior art. The plunger is used to compensate for the horizontal oscillations generated in the arrow shaft during the release and acceleration of the arrow. There are many disadvantages associated with prior art plungers. The tension on the plunger and the pressure it generates is adjusted by spring tension. One disadvantage of prior art plungers is that they use set screws for adjusting the tension on the spring to loosen or tighten the tension on the plunger. After a period of time, the set screws become loosened because of the vibration caused by the archery bow when shooting an arrow or striking against an object. Another disadvantage is that arrows are generally made of two materials: aluminum and carbon. Aluminum arrows are generally thicker in diameter and heavier, and are used for indoor shooting. Carbon arrows are generally thinner in diameter and lighter, and are used for outdoor shooting. Therefore, two plungers are required, one for aluminum arrows and one for carbon arrows. The extra plungers are not cost efficient. Another disadvantage in prior art plungers is that the tuning process for adjusting the plunger requires at least four (4) to six (6) hours and is usually inaccurate because it is done by guesswork. When the plunger is damaged and must be replaced with a new one, previous plungers do not have means for reproducing the previously set position of the plunger. With the plunger not having a previous reference point, the time consuming task of readjusting the plunger is required for the archery bow to shoot correctly again.

The following prior art references are relevant to the field of the present invention.

1. U.S. Pat. No. 4,170,980 issued to Killian on Oct. 16, 1979 for "Archery Bow Arrow Rest" (hereafter "the Killian Patent").

2. U.S. Pat. No. 4,542,731 issued to Quartino on Sep. 24, 1985 for "Bow With Vertically And Horizontally Adjustable Arrow Support" (hereafter "the Quartino Patent").

3. U.S. Pat. No. 4,648,376 issued to Saunders on Mar. 10, 1987 for "Self Cleaning Pressure Button" (hereafter "the Saunders Patent").

4. U.S. Pat. No. 4,924,841 issued to Smith on May 15, 1990 for "Arrow Guide" (hereafter the Smith Patent").

5. U.S. Pat. No. 5,081,980 issued to Newbold on Jan. 21, 1992 for "Plunger Arrow Rest" (hereafter "the Newbold Patent").

The Killian Patent discloses an arrow rest for an archery bow. The cylinder is threaded externally and the bore through the bow handle is threaded to provide a connection of the cylinder to the handle. A lock nut is threaded onto the outer projecting end of the cylinder to abut the outer surface of the handle and lock the cylinder securely in place. A locking screw is also provided in the threaded bore of the cylinder to abut the adjustment screw and retain the cylinder in the desired position of adjustment. The arrow rest arm is mounted pivotally on the support plate by the pivot pin for arcuate movement of the arm in opposite directions.

The Quartino Patent discloses a bow with vertical and horizontal adjustable arrow support. There is a vertical aperture extending through the bow handle section from the arrow side to the opposite side. A cylindrical support extends through the vertical aperture which is slidable in a vertical direction and when tightened, fixes the support member in a vertically adjusted position. The support member entering from the side opposite to the arrow side is a hollow cylinder and carries the inner end portion of an arrow spacing plunger. A jamb nut engaged on the hollow cylinder is tightened against the end of support member, and thereby locks the horizontal adjustment of the arrow spacing plunger.

The Saunders Patent discloses a self cleaning pressure button. It includes a housing adapted to extend through an opening in a bow handle which has a chamber. The chamber extends to an opening on one end. A plunger is slidably disposed within the chamber, and the plunger has one end extending through the opening and forming a small space between the one end of the plunger and the housing. A spring is provided within the plunger for biasing the plunger in a direction toward the arrow. An opening is provided for permitting air to enter the chamber, and a pump is disposed within the chamber for causing air to be forced out through the space between the housing and the plunger when the plunger operates as a shock absorber. A filter is provided in the chamber to prevent dirt from entering the chamber.

The Smith Patent discloses an arrow guide. It includes a hinge base, an arrow rest lever rod and a hollow threaded fastener which are removably affixed thereon. The hinge base is mounted onto the exterior surface of the bow in the area of the bow riser. The hinge base is retained in position on the bow by the hollow threaded fastener, which in turn is maintained in position by a lock nut. The arrow rest lever rod self-positions laterally in an approximate forty-five degree angle relative to the hinge base. A plunger disposed within the hollow threaded fastener is biased by a compression spring which is secured within the hollow threaded fastener by an adjustment screw. The adjustment screw is adapted to be threaded into the distal end of the hollow threaded fastener, thereby preventing the removal of the spring and the plunger.

The Newbold Patent discloses a plunger arrow rest. It includes a cushion plunger assembly and an arrow support. The cushion plunger assembly includes an elongated plunger, and is mounted to an archery bow to engage the side of an arrow with the plunger. A plunger bore extends longitudinally and concentrically into the plunger. The arrow support is a one piece metal wire extending through the mounting holes. The arrow support wire extends outward from the mounting hole at an elevation that is generally below the plunger to form a support arm.

None of the prior art patents are designed with a measuring device. In tensioning the plunger, the prior art patents employ a "try-and-adjust-after-error" technique which takes a considerable amount of time.

Therefore, there is a need for an improved plunger that will have precise measurements to facilitate the tuning process. It is desirable to design a plunger wherein the problem of set screws in prior art devices is eliminated. It is also desirable to have a universal plunger which can be utilized with both aluminum arrows and carbon arrows.

SUMMARY OF THE INVENTION

The present invention is a novel and unique adjustable plunger for an archery bow riser. The present invention utilizes the archery bow riser threaded aperture common to nearly all modern conventional archery bows. The adjustable plunger provides a considerably improved method for tuning plunger which absorbs the side pressure exerted by an arrow, so that the tuning process can take a matter of minutes instead of hours as occurs with conventional plungers. The present invention includes an index micro adjustment which has a linear tension indicator scale for tightening or loosening the tension of a biasing spring. The present invention is fully adjustable in a longitudinal direction.

It has been discovered, according to the present invention, that if an adjustable plunger has an indexed micro adjustment, it will provide a tuning means for accurately measuring the tension on the adjustable plunger, without shooting the arrow repeatedly until the bow shoots correct again.

It has also been discovered, according to the present invention, that if the adjustable plunger has eight dents on the indexed micro adjustment, then each dent represents 0.005 inch movement of the adjustable plunger.

It has additionally been discovered, according to the present invention, that if the adjustable plunger has eight numerals on the exterior surface of the adjustable plunger, then each numeral on the adjustable plunger represents each dent on the indexed micro adjustment.

It has further been discovered, according to the present invention, that if the adjustable plunger has a linear indicator scale with a multiplicity of divisions, then each division represents 0.04 inch movement of the adjustable plunger.

It has additionally been discovered, according to the present invention, that if the adjustable plunger has a linear scale on the exterior threaded portion of the adjustable plunger, it will provide means for accurately positioning the adjustable plunger in the longitudinal direction on the archery bow riser, without shooting the arrow repeatedly until the bow shoots correct again.

It has further been discovered, according to the present invention, that if the adjustable plunger has a magnifying glass, it will provide means to monitor the tension on the adjustable plunger by enabling the user to read the linear indicator scale through the magnifying glass.

It is therefore an object of the present invention to provide an improved adjustable plunger which can be easily adjusted without using any tools.

It is also an object of the present invention to provide an indexed micro adjustment means, so that it can be utilized for fine and rough tuning, thereby eliminating time consuming re-tuning of the plunger with repeated shoots.

It is a further object of the present invention to provide numerals on the adjustable plunger, so that each numeral corresponds to each dent on the indexed micro adjustment, and thereby confirming which position the adjustable plunger is in.

It is an additional object of the present invention to provide a linear scale on the exterior threaded portion of the adjustable plunger, so that the linear scale can be utilized to remount the adjustable plunger accurately without guessing.

It is a further object of the present invention to provide an adjustable plunger with a magnifying glass, so that the linear indicator scale can easily be read.

In the preferred embodiment of the present invention, the adjustable plunger is comprised of ten constituent parts. First, there is a generally cylindrical hollow housing with openings at opposite ends of the hollow housing, where one end has a larger diameter opening, and the opposite end has a smaller diameter opening. Second, there is an inner plunger disposed within the hollow housing and partially extending outwardly from the smaller diameter opening of the hollow housing. Third, there is a plastic tip member screwed onto the inner plunger. Fourth, there is a biasing means disposed into the hollow housing which engages with the inner plunger. Fifth, there is a magnifying glass integrally mounted to the exterior surface of the hollow housing for magnifying a linear indicator scale. Sixth, there is an index micro adjustment cap comprising eight dents which is used for covering the larger diameter opening of the hollow housing. Seventh, there is a screw which is screwed on top of the index micro adjustment cap. Eighth, there is a cylindrical sleeve disposed within the index micro adjustment cap which is used for compressing the biasing means onto the inner plunger. Ninth, there is a locking means for retaining the index micro adjustment cap within the larger diameter opening of the hollow housing. Tenth, there is a lock nut for retaining the adjustable plunger within the archery bow riser aperture.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG 1 is a perspective view of the present invention adjustable plunger threadedly mounted to an archery bow riser threaded aperture that is shown in dashed lines.

FIG. 2 is an exploded view of the preferred embodiment of the present invention adjustable plunger.

FIG. 3 is an enlarged cross-sectional view of the adjustable plunger.

FIG. 4 is a bottom view of the index micro adjustment cap which shows the eight equally spaced apart dents.

FIG. 5 is a perspective view of the cylindrical sleeve which shows the linear indicator scale.

FIG. 6 is a cross-sectional view of the adjustable plunger balancing the side pressure from the arrow.

FIG. 7 is a cross-sectional view taken along lines 7—7 of FIG. 3.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The novelty of the present invention is that the user will now have a reference point on re-tuning the adjustable plunger because of the linear scales on the present invention.

Referring to FIG. 1, there is an archery bow riser 2 shown in dashed lines and an adjustable plunger 4. The adjustable plunger 4 is threadedly mounted to a threaded aperture 6 in the archery bow riser 2, and is secured against the archery bow riser 2 by a lock nut or locking means 8. The adjustable plunger 4 can be adapted to any conventional archery bow riser. The adjustable plunger 4 is for absorbing the side pressure from an arrow, and guiding the arrow before and during the release of the arrow from the archery bow riser 2.

Referring to FIGS. 1, 2 and 3, there is shown an exploded view of the adjustable plunger 4. The adjustable plunger 4 includes a housing 10 which has a generally cylindrical hollow body with a first end 12, a middle portion 14 and a second end 16. The middle portion 14 includes a flange 18 which is located adjacent to the second end 16. The second end 16 includes numbers that start from 1 through 8 which surrounds the second end 16 and is equally spaced apart, three numbers being shown in FIG. 2. The first end 12 includes exterior screw threads 20 and a flat portion 21, so that the lock nut 8 can be threaded thereon prior to securing the hollow housing 10 to the archery bow riser 2. The flat portion 21 has a linear scale with a multiplicity of equally spaced apart divisions. Each division on the linear scale represents 0.032 inch. The linear scale has numbers that start at zero (0) and ends with eight (8) which are incrementing by twos. FIG. 1 illustrates four divisions between each number. The linear scale facilitates the positioning of the adjustable plunger 4 in the longitudinal direction on the archery bow riser 2. When the diameter of the arrow being used is changed, the adjustable plunger changes correspondingly in the longitudinal direction. With large diameter arrows, the adjustable plunger 4 is farther away from the riser 2. With small diameter arrows, the adjustable plunger 4 is closer to the riser 2. The linear scale is read from the interior perimeter of the riser 2. It will be appreciated that the linear scale is not limited to the numbers illustrated in FIG. 1. It is emphasized that while the linear scale with eight (8) numbers is the preferred embodiment, it is also within the spirit and scope of the present invention to have a multiplicity of numbers on the linear scale.

The present invention further comprises an inner plunger 22 comprising a generally cylindrical body which is slidably disposed within the hollow housing 10. The inner plunger 22 has a first end 24 with a threaded internal aperture 28 and an enlarged second end 26 with an aperture 30. The first end 24 extends outwardly from the first end 12 of the hollow housing 10 for receiving a plastic tip member 66. The inner plunger 22 is biased by a tapered spring means 52. When an arrow is engaged to the tip member 66, the inner plunger 22 is pushed longitudinal inward. The outward extension of the inner plunger 22 is limited by interference between the enlarged second end 26 of the inner plunger 22 and an inner flange section 70 defined by the second end 16 of the hollow housing 10. The plastic tip member 66 is threadedly mounted to the threaded aperture 28 of the inner plunger 22 for engaging with the side of the arrow.

Referring to FIGS. 2, 3, 4, 5 and 7, there is an index micro adjustment cap 32 comprising a base and a circumferential sidewall with a recess notch 31 at a location opposite to the base. The base includes an interior surface 34, an exterior surface 36 and a central threaded aperture 38. The circumferential sidewall includes a knurled exterior surface 40 for convenient gripping and an interior surface 42, which together with interior surface 34 of the base defines a chamber for receiving the second end 16 of the hollow housing 10. An elongated screw 44 is screwed onto the central threaded aperture 38 of the index micro adjustment cap 32 and extends into the chamber of the index micro adjustment cap 32. A cylindrical sleeve 46 is disposed within the chamber of the index micro adjustment cap 32. The cylindrical sleeve 46 includes a base comprising a central threaded aperture 48, and a sidewall comprising an exterior surface 58 and an interior surface 50, which overlaps on the enlarged second end 26 of the inner plunger 22. The cylindrical sleeve 46 is threaded onto the elongated screw 44. The tapered biasing spring or biasing means 52 is disposed within the aperture 30 of the enlarged second end 26 of the inner plunger 22 and engaged between the base of the cylindrical sleeve 46 and against the inner plunger 22.

A locking ring or locking means 60 is disposed within an exterior groove 62 of the hollow housing 10, and an interior groove 64 of the circumferential interior sidewall of the index micro adjustment cap 32, and thereby secures the index micro adjustment cap 32 to the second end 16 of the hollow housing 10.

A spring 55 and a biased regulating ball 59 are disposed in a small rim aperture 53 at the second end 16 of the hollow housing 10 for engaging against eight equally spaced apart dents 54 which are located on the interior surface 34 of the index micro adjustment cap 32, as shown in FIG. 4. Each dent 54 on the index micro adjustment cap 32 represents 0.005 inch movement of the cylindrical sleeve 46. Each dent 54 also corresponds to a number on the second end 16 of the hollow housing 10. The number is to assist the user to identify where each dent 54 is at. By rotating the cap 32, the recess notch 31 on the cap uncovers a number on the second end 16 of the hollow housing 10. The eight dents 54 make one complete revolution and is equal to 0.04 inch movement of the cylindrical sleeve 46. By rotating the index micro adjustment cap 32, the spring 55 and the biased regulating ball 59 engages with each of the dents 54, and can be felt by a clicking effect on the index micro adjustment cap 32.

A magnifying glass 56 is integrally mounted to a side opening 72 by adhesive means 57, as shown in FIG. 7. The magnifying glass 56 is located at the second end 16 of the hollow housing 10 and is adjacent to the middle portion 14. The magnifying glass 56 magnifies a linear indicator scale marked on the exterior surface 58 of the sidewall of the cylindrical sleeve 46, as shown in FIG. 5. This linear indicator scale is utilized for compensating the force caused by the side vibration of the arrow. It includes a multiplicity of equally spaced apart divisions. Each division on the cylindrical sleeve 46 represents one complete revolution of the index micro adjustment cap 32 and is equal to 0.04 inch movement of the cylindrical sleeve 46. It is emphasized that while the preferred embodiment has eight dents 54 on the interior surface 34 of the index micro adjustment cap 32 and eight divisions on the cylindrical sleeve 46, it is also within the spirit and scope of the present invention to have a multiplicity of dents and a multiplicity of divisions incorporated into the index micro adjustment cap and the cylindrical sleeve respectively.

The adjustable plunger 4 can be manufactured with or without the magnifying glass 56. The objective of the magnifying glass 56 is to enlarge the linear indicator scale on the cylindrical sleeve 46, so that one can read how much tension has been set on the adjustable plunger 4. The adjustable plunger 4 is assembled by first disposing the inner plunger 22 within the hollow housing 10. Second, the plastic tip member 66 is screwed onto the inner plunger 22. Third, the tapered biasing spring or biasing means 52 is disposed within the hollow housing 10, and engaged between the inner plunger 22 and the cylindrical sleeve 46. Fourth, the locking means 60 is disposed within the exterior groove 62. Fifth, the cylindrical sleeve 46 is screwed onto the screw which extends into the chamber of the index micro adjustment cap 32. Sixth, the index micro adjustment cap 32 is placed over the hollow housing 10, and is thereby secured by locking means 60. The adjustable plunger 4 is ready to be utilized.

Referring to FIG. 6, there is shown a cross-sectional view of the adjustable plunger 4 and an arrow 5. FIG. 6 shows the adjustable plunger 4 absorbing the side pressure of the arrow 5. In operation, the adjustable plunger 4 can be adjusted in a longitudinal direction by rotating the index micro adjustment cap 32 to set the tension of the inner plunger 22, and thereby the tension of the inner plunger 22 can be monitored by reading the linear indicator scale on the cylindrical sleeve 46 through the magnifying glass 56. When the index micro adjustment cap rotates counter-clockwise, the cylindrical sleeve 46 applies pressure on the tapered biasing spring or biasing means 52 by compressing the biasing means 52 onto the inner plunger 22, and thereby tightening the tension on the inner plunger 22. By rotating the index micro adjustment cap 32 clockwise, one can loosen the tension on the inner plunger 22.

One of the unique features of the present invention is that the plunger tension can be set precisely and be accurately measured, instead of using guesswork as do conventional plungers. Once a proper tension has been achieved, the user only needs to remember or write down on a piece of paper which division on the linear indicator scale has been reached on the cylindrical sleeve 46 and which dent 54 has been used on rotation of the index micro adjustment cap 32.

Another one of the unique features of the present invention is that set screws are not utilized for setting the tension, as compared to conventional plungers. Such set screws can become loosened over time, thereby leading to a faulty tension adjustment.

A further unique feature of the present invention is that the adjustable plunger can be utilized with a milling machine or lathe machine.

The present invention has many advantageous features including: (a) a linear indicator scale for showing the tension of the plunger; (b) a linear scale for showing the longitudinal direction of the adjustable plunger; (c) it is very easy to use; (d) the adjustable plunger does not require any set screws as conventional plungers; and (e) a magnifying glass which is utilized for enlarging the linear indicator scale on the cylindrical sleeve.

Defined in detail, the present invention is an adjustable plunger threadedly mounted to a threaded aperture on an archery bow riser for guiding an arrow before and during the release of the arrow from the archery bow riser, the adjustable plunger comprising: (a) a housing having a generally hollow cylindrical body with a first end and a second end, the second end having a flange and eight of numbers equally spaced apart, and the first end having exterior screw threads and a flat portion with a linear scale having a multiplicity of divisions for measuring a longitudinal direction of said archery bow riser; (b) a locking nut threaded thereon to said exterior screw threads of said hollow housing located adjacent to said flange, where the locking nut secures said hollow housing to said archery bow riser; (c) an inner plunger having a generally cylindrical body and slidably disposed within said hollow housing, the inner plunger having a first end and an enlarged second end, the first end extending out from said first end of said hollow housing and having an interior threaded aperture, and the enlarged second end having an aperture; (d) an index micro adjustment cap having a base and a circumferential sidewall, the base having an interior surface, an exterior surface and a central threaded aperture, the circumferential sidewall having a knurled exterior surface and an interior surface which together with the interior surface of the base defines a chamber for receiving said second end of said hollow housing; (e) a recess notch located on said knurled exterior surface which is opposite to said base of said index micro adjustment cap for exposing said eight numbers at said second end of said hollow housing when said cap is rotated; (f) an elongated screw threaded through to said central threaded aperture of said index micro adjustment cap, and extending into said chamber of said index micro adjustment cap; (g) a cylindrical sleeve disposed within said chamber of said index micro adjustment cap, the cylindrical sleeve having a base and a sidewall, the base having a central threaded aperture for having the cylindrical sleeve threaded on said elongated screw, the sidewall having an exterior surface and an interior surface which is overlapped on said enlarged second end of said inner plunger; (h) a tapered biasing spring disposed within said aperture of said enlarged second end of said inner plunger and engaged between said base of said cylindrical sleeve and said inner plunger; (i) a spring and a biased regulating ball disposed in a small rim aperture at said second end of said hollow housing respectively for engaging against eight equally spaced dents located on said interior surface of said base of said index micro adjustment cap positioned corresponding to said eight numbers at said second end of said hollow housing; (j) a magnifying glass integrally mounted at a side opening at said second end of said hollow housing for engaging with said exterior surface of said sidewall of said cylindrical sleeve to magnify a linear indicator scale marked on said exterior surface of said sidewall of said cylindrical sleeve which has eight equally spaced divisions positioned corresponding to said eight dents on said index micro adjustment cap; (k) a locking ring disposed within an exterior groove on said second end of said hollow housing and engaging against an interior groove of said circumferential sidewall of said index micro adjustment cap for securing said index micro adjustment cap to said second end of said hollow housing; and (l) a plastic tip member threadedly mounted to said threaded aperture of said first end of said inner plunger for engagement with said arrow; (m) whereby said adjustable plunger can be adjusted in a longitudinal direction by rotating said index micro adjustment cap to set the tension of said inner plunger, and the tension of said inner plunger can be monitored by reading said linear indicator scale through said magnifying glass.

Defined broadly, the present invention is an adjustable plunger threadedly mounted to a threaded aperture on a bow riser for guiding an arrow before and during the release of the arrow from the bow riser, the adjustable plunger comprising: (a) a hollow housing having a top end and a bottom end, the top end having a flange and a multiplicity of numbers, and the bottom end having threads and a flat portion with a scale having a multiplicity of divisions for measuring a longitudinal direction of said bow riser; (b) a locking means screwed onto said threads of said hollow housing, where the locking means secures said hollow housing to said bow riser; (c) an inner plunger slidably disposed within said hollow housing, the inner plunger having two opposite ends, one end extending out from said bottom end of said hollow housing and having a threaded aperture and the opposite end having an aperture; (d) an adjustment cap having a base and a sidewall, the base having an interior surface, an exterior surface and a threaded aperture, the sidewall having an exterior surface and an interior surface which together with the interior surface of the base defines a chamber for receiving said top end of said hollow housing and a screw threaded through said threaded aperture of the adjustment cap, and extending into said chamber of said adjustment cap; (e) a recess notch located on said exterior surface of said sidewall of said adjustment cap for exposing said multiplicity of numbers at said top end of said hollow housing when said adjustment cap is rotated; (f) a sleeve disposed within said chamber of said adjustment cap and within said top end of said hollow housing, the sleeve having a base and a sidewall with a scale having a multiplicity of equally spaced apart divisions and located adjacent to a side opening at said top end of said hollow housing and over said opposite end of said plunger, the base having a threaded aperture for having the sleeve threaded on said screw; (g) a biasing means disposed within said aperture of said opposite end of said inner plunger and engaged between said base of said sleeve and said inner plunger; (h) a spring biased regulating ball disposed in a rim aperture at said top end of said hollow housing for engaging against a multiplicity of equally spaced dents located on said interior surface of said base of said adjustment cap positioned corresponding to said multiplicity of numbers at said top end of said hollow housing; (i) means for securing said sidewall of said adjustment cap to said top end of said hollow housing; and (j) a tip member threadedly mounted to said threaded aperture of said one end of said inner plunger for engagement with said arrow; (k) whereby said adjustable plunger can be adjusted in a longitudinal direction by rotating said adjustment cap to set the tension of said inner plunger, and the tension of said inner plunger can be monitored by reading said scale.

Defined more broadly, the present invention is an adjustable plunger for a riser and an arrow, comprising: (a) a housing having two ends and means for securing the housing to said riser; (b) a plunger having two ends and slidably disposed within said housing; (c) an adjustment means having an interior chamber for receiving a respective one of said two ends of said housing, and a sleeve disposed within the interior chamber of the adjustment means; (d) means for engaging between said sleeve and said plunger; and (e) means for securing said adjustment means to said housing; (f) whereby said adjustable plunger can be adjusted in a longitudinal direction by rotating said adjustment means to set the tension of said plunger.

Alternatively defined in detail, the present invention is an adjustable plunger mounted through an aperture on a device, the adjustable plunger comprising: (a) a hollow housing having a top end and a bottom end, the top end having a flange and a multiplicity of equally spaced apart numbers, the bottom end having threads, so that a locking nut can be threaded thereon to secure the hollow housing to said device; (b) a scale having a multiplicity of equally spaced apart divisions on said hollow housing for measuring a longitudinal direction of said adjustable plunger; (c) an inner plunger slidably disposed within said hollow housing, the inner plunger having two opposite ends, one end extending out from said bottom end of said hollow housing and having a threaded aperture and the opposite end having an aperture; (d) an adjustment cap having a base and a sidewall, the base having an interior surface, an exterior surface and a threaded aperture, the sidewall having an exterior surface and an interior surface which together with the interior surface of the base defines a chamber for receiving said top end of said hollow housing and a screw threaded through said threaded aperture of the adjustment cap, and extending into said chamber of said adjustment cap; (e) a recess notch on said exterior surface of said index micro adjustment cap for exposing said multiplicity of numbers at said top end of said hollow housing when said cap is rotated; (f) a sleeve disposed within said chamber of said adjustment cap and within said top end of said hollow housing, the sleeve having a base and a sidewall with a scale having a multiplicity of equally spaced apart divisions and located adjacent to a side opening at said top end of said hollow housing and over said opposite end of said plunger, the base having a threaded aperture for having the sleeve threaded on said screw; (g) a spring disposed within said aperture of said opposite end of said inner plunger and engaged between said base of said sleeve and said inner plunger; (h) a spring biased regulating ball disposed in a rim aperture at said top end of said hollow housing for engaging against a multiplicity of equally spaced apart dents located on said interior surface of said base of said adjustment cap positioned corresponding to said multiplicity of numbers at said top end of said hollow housing; (i) means for securing said sidewall of said adjustment cap to said top end of said hollow housing; and (j) a tip member threadedly mounted to said threaded aperture of said one end of said inner plunger; (k) whereby said adjustable plunger can be adjusted in a longitudinal direction by rotating said adjustment cap to set the tension of said inner plunger, and the tension of said inner plunger can be monitored by reading said scale.

Also alternatively defined broadly, the present invention is an adjustable plunger threadedly mounted to a threaded aperture on a bow riser for guiding an arrow before and during the release of the arrow from the bow riser, the adjustable plunger comprising: (a) a hollow housing having a top end and a bottom end with threads, where the bottom end is screwed onto said threaded aperture in said bow riser, and means for securing said hollow housing to said bow riser; (b) a scale having a multiplicity of marked indicia thereon, the scale located on said bottom end of said hollow housing for measuring a longitudinal direction of said adjustable plunger; (c) an inner plunger slidably disposed within said hollow housing, the inner plunger having two opposite ends, one end extending out from said bottom end and having means for retaining a tip member, the opposite end having an aperture; (d) an adjustment cap having a base and an interior chamber for receiving said top end of said hollow housing; (e) a sleeve disposed within said chamber of said adjustment cap, and within the top end of said hollow housing, the sleeve having a base and a sidewall with a scale having a multiplicity of marked indicia thereon, the scale located adjacent to a side opening at the top end of said hollow housing, and means for affixing said sleeve to said adjustment cap; (f) a biasing means disposed within said aperture of said opposite end of said inner plunger and engaged between said base of said sleeve and said inner plunger; (g) regulating means located at said top end of said hollow housing for respective engagement against a multiplicity of equally spaced dents located on said base of said adjustment cap; and (h) means for securing said sidewall of said adjustment cap to said top end of said hollow housing.

Further alternatively defined broadly, the present invention is an adjustable plunger mounted through an aperture on a device, the adjustable plunger comprising: (a) a hollow housing having a top end and a bottom end, where the bottom end is inserted through said aperture in said device, and means for securing said hollow housing to said device; (b) a scale having a multiplicity of marked indicia thereon, the scale located on said bottom end of said hollow housing for measuring a longitudinal direction of said device; (c) an inner plunger slidably disposed within said hollow housing, the inner plunger having two opposite ends, one end extending out from said bottom end and having means for retaining a tip member, the opposite end having an aperture; (d) an adjustment cap having a base and an interior chamber for receiving said top end of said hollow housing; (e) a sleeve disposed within said chamber of said adjustment cap, and within the top end of said hollow housing, the sleeve having a base and a sidewall with a scale having a multiplicity of marked indicia thereon, the scale located adjacent to a side opening at the top end of said hollow housing, and means for affixing said sleeve to said adjustment cap; (f) a biasing means disposed within said aperture of said opposite end of said inner plunger and engaged between said base of said sleeve and said inner plunger; (g) regulating means located at said top end of said hollow housing for respective engagement against a multiplicity of equally spaced dents located on said base of said adjustment cap; and (h) means for securing said sidewall of said adjustment cap to said top end of said hollow housing.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An adjustable plunger threadedly mounted to a threaded aperture on an archery bow riser for guiding an arrow before and during release of the arrow from the archery bow riser, the adjustable plunger comprising:

a. a housing having a generally hollow cylindrical body with a first end and a second end, the second end having a flange and eight numbers equally spaced apart, and the first end having exterior screw threads and a fiat portion with a linear scale having a multiplicity of divisions for measuring a longitudinal direction of said adjustable plunger;

b. a locking nut threaded thereon to said exterior screw threads of said hollow housing located adjacent to said flange, where the locking nut secures said hollow housing to said archery bow riser;

c. an inner plunger having a generally cylindrical body and slidably disposed within said hollow housing, the inner plunger having a first end and an enlarged second end, the first end extending out from said first end of said hollow housing and having an interior threaded aperture, and the enlarged second end having an aperture;

d. an index micro adjustment cap having a base and a circumferential sidewall, the base having an interior surface, an exterior surface and a central threaded aperture, the circumferential sidewall having a knurled exterior surface and an interior surface which together with the interior surface of the base defines a chamber for receiving said second end of said hollow housing;

e. a recess notch located on said knurled exterior surface which is opposite to said base of said index micro adjustment cap for exposing said eight numbers at said second end of said hollow housing when said cap is rotated;

f. an elongated screw threaded through said central threaded aperture of said base of said index micro adjustment cap, and extending into said chamber of said index micro adjustment cap;

g. a cylindrical sleeve disposed within said chamber of said index micro adjustment cap, the cylindrical sleeve having a base and a sidewall, the base having a central threaded aperture for having the cylindrical sleeve threaded on said elongated screw, the sidewall having an exterior surface and an interior surface which is overlapped on said enlarged second end of said inner plunger;

h. a tapered biasing spring disposed within said aperture of said enlarged second end of said inner plunger and engaged between said base of said cylindrical sleeve and said inner plunger;

i. a spring and a biased regulating ball disposed in a small rim aperture at said second end of said hollow housing for respectively engaging against eight equally spaced dents located on said interior surface of said base of said index micro adjustment cap positioned corresponding to said eight numbers at said second end of said hollow housing;

j. a magnifying glass integrally mounted at a side opening at said second end of said hollow housing for engaging with said exterior surface of said sidewall of said cylindrical sleeve to magnify a linear indicator scale marked on said exterior surface of said sidewall of said cylindrical sleeve which has eight equally spaced divisions positioned corresponding to said eight dents on said index micro adjustment cap;

k. a locking ring disposed within an exterior groove on said second end of said hollow housing and engaging against an interior groove of said circumferential sidewall of said index micro adjustment cap for securing said index micro adjustment cap to said second end of said hollow housing; and l. a plastic tip member threadedly mounted to said threaded aperture of said first end of said inner plunger for engagement with said arrow;

m. whereby said adjustable plunger can be adjusted in said longitudinal direction by rotating said index micro adjustment cap to set a tension of said inner plunger, and the tension of said inner plunger can be monitored by reading said linear indicator scale through said magnifying glass.

2. The adjustable plunger as defined in claim 1 wherein said each division of said linear scale on said flat portion of said hollow housing corresponds to 0.032 inch movement of said adjustable plunger.

3. The adjustable plunger as defined in claim 1 wherein said each dent on said interior surface of said index micro adjustment cap corresponds to 0.005 inch movement of said inner plunger.

4. The adjustable plunger as defined in claim 1 wherein said each division on said sidewall of said cylindrical sleeve corresponds to 0.04 inch movement of said inner plunger.

5. An adjustable plunger threadedly mounted to a threaded aperture on a bow riser for guiding an arrow before and during release of the arrow from the bow riser, the adjustable plunger comprising:

a. a hollow housing having a top end and a bottom end, the top end having a flange and a multiplicity of numbers, and the bottom end having threads and a flat portion with a scale having a multiplicity of divisions for measuring a longitudinal direction of said adjustable plunger;

b. a locking means screwed onto said threads of said hollow housing, where the locking means secures said hollow housing to said bow riser;

c. an inner plunger slidably disposed within said hollow housing, the inner plunger having two opposite ends, one end extending out from said bottom end of said hollow housing and having a threaded aperture and the opposite end having an aperture;

d. an adjustment cap having a base and a sidewall, the base having an interior surface, an exterior surface and a threaded aperture, the sidewall having an exterior surface and an interior surface which together with the interior surface of the base defines a chamber for receiving said top end of said hollow housing, and a screw threaded through said threaded aperture of the adjustment cap, and extending into said chamber of said adjustment cap;

e. a recess notch located on said exterior surface of said sidewall of said adjustment cap for exposing said multiplicity of numbers at said top end of said hollow housing when said adjustment cap is rotated;

f. a sleeve disposed within said chamber of said adjustment cap and within said top end of said hollow housing, the sleeve having a base and a sidewall with an indicator scale having a multiplicity of equally spaced apart divisions and located adjacent to a side opening at said top end of said hollow housing and over said opposite end of said plunger, the base having a threaded aperture for having the sleeve threaded on said screw;

g. a biasing means disposed within said aperture of said opposite end of said inner plunger and engaged between said base of said sleeve and said inner plunger;

h. a spring biased regulating ball disposed in a rim aperture at said top end of said hollow housing for respectively engaging against a multiplicity of equally spaced dents located on said interior surface of said base of said adjustment cap positioned corresponding to said multiplicity of numbers at said top end of said hollow housing;

i. means for securing said sidewall of said adjustment cap to said top end of said hollow housing; and j. a tip member threadedly mounted to said threaded aperture of said one end of said inner plunger for engagement with said arrow;

k. whereby said adjustable plunger can be adjusted in said longitudinal direction by rotating said adjustment cap to set a tension of said inner plunger, and the tension of said inner plunger can be monitored by reading said scale.

6. The adjustable plunger as defined in claim 5 wherein said each division on said scale of said hollow housing corresponds to 0.032 inch movement of said adjustable plunger.

7. The adjustable plunger as defined in claim 5 wherein said multiplicity of dents comprises at least eight dents on said interior surface of said adjustment cap, where each dent corresponds to 0.005 inch movement of said inner plunger.

8. The adjustable plunger as defined in claim 5 wherein said multiplicity of divisions comprises at least eight divisions on said sidewall of said sleeve, where each division corresponds to 0.04 inch movement of said inner plunger.

9. The adjustable plunger as defined in claim 5 wherein said locking means is a lock nut.

10. The adjustable plunger as defined in claim 5 wherein said means for securing said sidewall of said adjustment cap to said top end of said hollow housing is a locking ring.

11. The adjustable plunger as defined in claim 5 wherein said tip member is made of plastic material.

12. The adjustable plunger as defined in claim 5 wherein said adjustment cap is an index micro adjustment.

13. The adjustable plunger as defined in claim 5 wherein said scale which is on said flat portion of said bottom end of said housing is a linear scale.

14. The adjustable plunger as defined in claim 5 further comprising a magnifying glass integrally mounted at said side opening at said top end of said hollow housing adjacent to said top end for magnifying said indicator scale on said sleeve.

15. An adjustable plunger mounted to a riser for guiding an arrow, comprising:

a. a housing having two ends and means for securing the housing to said riser;

b. a plunger having two ends and slidably disposed within said housing;

c. an adjustment means having an interior chamber for receiving a respective one of said two ends of said housing, and a sleeve disposed within the interior chamber of the adjustment means;

d. means for engaging between said sleeve and said plunger;

e. means for securing said adjustment means to said housing; and f. a spring and a bias regulating ball disposed in a small rim aperture at said respective one of said two ends of said housing for engaging against a multiplicity of dents equally spaced apart and located on said adjustment means;

g. whereby said adjustable plunger can be adjusted in a longitudinal direction by rotating said adjustment means to set a tension of said plunger.

16. The adjustable plunger as defined in claim 15 wherein said means for securing the housing to said riser includes a locking nut.

17. The adjustable plunger as defined in claim 15 wherein said means for engaging between said sleeve and said plunger includes a tapered biasing spring.

18. The adjustable plunger as defined in claim 15 wherein said means for securing said adjustment means to said housing includes a locking ring.

19. The adjustable plunger as defined in claim 15 wherein said adjustment means is an index micro adjustment cap.

20. The adjustable plunger as defined in claim 15 further comprising a plastic tip member attached to a respective one of said two ends of said plunger for engaging with said arrow.

21. The adjustable plunger as defined in claim 15 wherein each one of said dents on said adjustment means corresponds to 0.005 inch movement of said plunger.

22. An adjustable plunger mounted to a riser for guiding an arrow, comprising:

a. a housing having two ends and means for securing the housing to said riser;

b. a plunger having two ends and slidably disposed within said housing;

c. an adjustment means having an interior chamber for receiving a respective one of said two ends of said housing, and a sleeve disposed within the interior chamber of the adjustment means;

d. means for engaging between said sleeve and said plunger;

e. means for securing said adjustment means to said housing; and f. a linear scale with a multiplicity of divisions at said respective one of said two ends of said housing;

g. whereby said adjustable plunger can be adjusted in a longitudinal direction by rotating said adjustment means to set a tension of said plunger.

23. The adjustable plunger as defined in claim 22 wherein said each division on said linear scale corresponds to 0.032 inch movement of said adjustable plunger.

24. The adjustable plunger as defined in claim 22 further comprising a multiplicity of numbers at said respective one of said two ends of said housing, where each number corresponds to a respective one of a multiplicity of dents on said adjustment means.

25. An adjustable plunger mounted to a riser for guiding an arrow, comprising:

a. housing having two ends and means for securing the housing to said riser;

b. a plunger having two ends and slidably disposed within said housing;

c. an adjustment means having an interior chamber for receiving a respective one of said two ends of said housing, and a sleeve disposed within the interior chamber of the adjustment means;

d. means for engaging between said sleeve and said plunger;

e. means for securing said adjustment means to said housing; and f. a magnifying glass integrally mounted at a side opening at said respective one of said two ends of said housing for magnifying a linear indicator scale marked on said sleeve which includes a multiplicity of equally spaced apart divisions;

g. whereby said adjustable plunger can be adjusted in a longitudinal direction by rotating said adjustment means to set a tension of said plunger.

26. The adjustable plunger as defined in claim 25 wherein each one of said divisions on said sleeve corresponds to 0.04 inch movement of said plunger.

27. An adjustable plunger mounted through an aperture on a device, the adjustable plunger comprising:

a. a hollow housing having a top end and a bottom end, the top end having a flange and a multiplicity of equally spaced apart numbers, the bottom end having threads, so that a locking nut can be threaded thereon to secure the hollow housing to said device;

b. a scale having a multiplicity of equally spaced apart divisions on said hollow housing for measuring a longitudinal direction of said adjustable plunger;

c. an inner plunger slidably disposed within said hollow housing, the inner plunger having two opposite ends, one end extending out from said bottom end of said hollow housing and having a threaded aperture and the opposite end having an aperture;

d. an adjustment cap having a base and a sidewall, the base having an interior surface, an exterior surface and a threaded aperture, the sidewall having an exterior surface and an interior surface which together with the interior surface of the base defines a chamber for receiving said top end of said hollow housing and a screw threaded through said threaded aperture of the base of the adjustment cap, and extending into the chamber of the adjustment cap;

e. a recess notch on said exterior surface of said adjustment cap for exposing said multiplicity of numbers at said top end of said hollow housing when said cap is rotated;

f. a sleeve disposed within said chamber of said adjustment cap and within said top end of said hollow housing, the sleeve having a base and a sidewall with an adjustor scale having a multiplicity of equally spaced apart divisions and located adjacent to a side opening at said top end of said hollow housing and over said opposite end of said plunger, the base having a threaded aperture for having the sleeve threaded on said screw;

g. a spring disposed within said aperture of said opposite end of said inner plunger and engaged between said base of said sleeve and said inner plunger;

h. a spring biased regulating ball disposed in a rim aperture at said top end of said hollow housing for engaging against a multiplicity of equally spaced apart dents located on said interior surface of said base of said adjustment cap positioned corresponding to said multiplicity of numbers at said top end of said hollow housing;

i. means for securing said sidewall of said adjustment cap to said top end of said hollow housing; and j. a tip member threadedly mounted to said threaded aperture of said one end of said inner plunger;

k, whereby said adjustable plunger can be adjusted in said longitudinal direction by rotating said adjustment cap to set a tension of said inner plunger, and the tension of said inner plunger can be monitored by reading said scale.

28. The adjustable plunger as defined in claim 27 wherein said multiplicity of divisions on said scale of said hollow housing each of which corresponds to 0.032 inch in said longitudinal direction of said adjustable plunger.

29. The adjustable plunger as defined in claim 27 wherein said multiplicity of dents comprises at least eight dents on said interior surface of said adjustment cap, where each dent corresponds to 0.005 inch movement of said inner plunger.

30. The adjustable plunger as defined in claim 27 wherein said multiplicity of divisions comprises at least eight divisions on said sidewall of said sleeve, where each division corresponds to 0.04 inch movement of said inner plunger.

31. The adjustable plunger as defined in claim 27 wherein said means for securing said sidewall of said adjustment cap to said top end of said hollow housing is a locking ring.

32. The adjustable plunger as defined in claim 27 wherein said tip member is made of plastic material.

33. The adjustable plunger as defined in claim 27 wherein said adjustment cap is an index micro adjustment.

34. The adjustable plunger as defined in claim 27 wherein said scales are linear scales.

35. The adjustable plunger as defined in claim 27 further comprising a magnifying glass integrally mounted at said side opening at said top end of said hollow housing for magnifying said scale on said sleeve.

36. An adjustable plunger threadedly mounted to a threaded aperture on a bow riser for guiding an arrow before and during release of the arrow from the bow riser, the adjustable plunger comprising:

a. a hollow housing having a top end and a bottom end with threads, where the bottom end is screwed onto said threaded aperture in said bow riser, and means for securing said hollow housing to said bow riser;

b. a scale having a multiplicity of marked indicia thereon, the scale located on said bottom end of said hollow housing for measuring a longitudinal direction of said adjustable plunger;

c. an inner plunger slidably disposed within said hollow housing, the inner plunger having two opposite ends, one end extending out from said bottom end and having means for retaining a tip member, the opposite end having an aperture;

d. an adjustment cap having a base and an interior chamber for receiving said top end of said hollow housing;

e. a sleeve disposed within said chamber of said adjustment cap, and within the top end of said hollow housing, the sleeve having a base and a sidewall with a scale having a multiplicity of marked indicia thereon, the scale located adjacent to a side opening at the top end of said hollow housing, and means for affixing said sleeve to said adjustment cap;

f. a biasing means disposed within said aperture of said opposite end of said inner plunger and engaged between said base of said sleeve and said inner plunger;

g. regulating means located at said top end of said hollow housing for respective engagement against a multiplicity of equally spaced dents located on said base of said adjustment cap; and h. means for securing said sidewall of said adjustment cap to said top end of said hollow housing.

37. An adjustable plunger mounted through an aperture on a device, the adjustable plunger comprising:

a. a hollow housing having a top end and a bottom end, where the bottom end is inserted through said aperture in said device, and means for securing said hollow housing to said device;

b. a scale having a multiplicity of marked indicia thereon, the scale located on said bottom end of said hollow housing for measuring a longitudinal direction of said adjustable plunger;

c. an inner plunger slidably disposed within said hollow housing, the inner plunger having two opposite ends, one end extending out from said bottom end and having means for retaining a tip member, the opposite end having an aperture;

d. an adjustment cap having a base and an interior chamber for receiving said top end of said hollow housing;

e. a sleeve disposed within said chamber of said adjustment cap, and within the top end of said hollow housing, the sleeve having a base and a sidewall with a scale having a multiplicity of marked indicia thereon, the scale located adjacent to a side opening at the top end of said hollow housing, and means for affixing said sleeve to said adjustment cap;

f. a biasing means disposed within said aperture of said opposite end of said inner plunger and engaged between said base of said sleeve and said inner plunger;

g. regulating means located at said top end of said hollow housing for respective engagement against a multiplicity of equally spaced dents located on said base of said adjustment cap; and h. means for securing said sidewall of said adjustment cap to said top end of said hollow housing.

* * * * *